United States Patent [19]

Kielmeyer

[11] Patent Number: 4,545,166

[45] Date of Patent: Oct. 8, 1985

[54] CEILING INSULATION SYSTEM

[75] Inventor: William H. Kielmeyer, Englewood, Colo.

[73] Assignee: Manville Service Corporation, Denver, Colo.

[21] Appl. No.: 553,465

[22] Filed: Nov. 21, 1983

[51] Int. Cl.[4] ..... E04B 5/52

[52] U.S. Cl. ..... 52/484; 52/489; 52/665

[58] Field of Search ..... 52/484, 489, 664, 665

[56] References Cited

U.S. PATENT DOCUMENTS

| | | | |
|---|---|---|---|
| 3,385,020 | 5/1968 | Olson | 52/664 X |
| 3,509,671 | 5/1970 | Akerson | 52/484 X |
| 3,708,941 | 1/1973 | Cuckson | 52/484 |
| 3,911,638 | 10/1975 | Englund et al. | 52/489 |
| 4,019,300 | 4/1977 | Sauer et al. | 52/665 |
| 4,084,364 | 4/1978 | Jones | 52/484 |
| 4,089,146 | 5/1978 | Martinez | 52/484 |
| 4,191,352 | 3/1980 | Schuplin | 52/484 X |
| 4,206,578 | 6/1980 | Mieyal | 52/484 X |
| 4,384,437 | 5/1983 | Coles | 52/484 X |
| 4,408,428 | 10/1983 | Brooke et al. | 52/489 |

*Primary Examiner*—J. Karl Bell

*Attorney, Agent, or Firm*—John D. Lister; Timothy R. Schulte

[57] ABSTRACT

A ceiling insulation system for commercial buildings. The present invention provides an attractive ceiling panel system with a functional insulation and water vapor barrier system with an insulating R-value of 44 and a perm rating of 0.4. A hat-shaped channel is suspendable from bar joist, steel purlin, or wood joist by using one of three different suspension fasteners. A C-shaped clamp with locking ring, a cylindrical rod and two spring clamps complete the suspension subassembly. Channel junction clips and board edge clamps are used to insure the integrity of the system and enable a high insulation value and a low perm value.

21 Claims, 8 Drawing Figures

CEILING INSULATION SYSTEM

BACKGROUND AND SUMMARY OF THE INVENTION

The present invention is directed to an insulation system for use in various commercial buildings such as warehouses, factories, showrooms and the like. More particularly the present invention relates to a ceiling insulation system which can be quickly and easily installed in such buildings to provide whatever insulating R-value/desired.

Various ceiling grid systems have been devised. Most of these systems are designed to support decorative or acoustical panels and are, therefore, incapable of supporting the weight of adequate amounts of insulation. Also, a number of insulation systems have been devised in which insulation boards and/or batts are supported directly by or in close proximity to the ceiling joists or purlins. The problem with such a system is its lack of flexibility. Dropping the ceiling in a commercial building can significantly reduce the amount of air space which must be heated and/or air-conditioned. Further, by dropping the ceiling, one is not limited as with some systems by the height of the joist/purlin (less space required for light fixtures, sprinkler system, etc.) in determining the amount of insulation to be installed.

Other problems with known suspension systems include the use of a channel with a penetrating aperture to suspend the system. Such apertures can provide routes for air and moisture to penetrate the insulation and vapor barrier, respectively. In addition, these apertures weaken the channel structure and create areas of potential bending, sagging and breakage. Further, the formation of these apertures can leave burrs and metal splinters which pose handling hazzards for the installers.

The ceiling insulation system of the present invention solves these problems by providing a suspending grid whose height can be varied. The system, which may be installed in new construction or retrofit into existing structures, employs a hat-shaped channel which is reinforced by rolled edges. The channel has a non-penetrating recess or set of grooves by which it is suspended. These grooves, rather than structurally weakening the channel, serve to further reinforce it. The suspension system and channel are designed to continuously support 50 to 80 pounds with an ultimate load of 250 pounds (a 5 to 1 safety margin). Further, unlike other insulation systems which require installation in stages, i.e., all of the hangers, then all of the channels, then all of the board, then all of the clips, then all of the batts, the present insulation system can be installed on an "as-you-go" basis. This eliminates the need for multiple moving of ladders, scaffolding, etc., back and forth over the same area. Hence, the present system can be installed much more easly and quickly. The suspension system can be height adjusted to permit the use of as thick an insulation batt as necessary to provide the R-value desired. Further, the insulation gives the combination of a functional insulation system and the finished appearance of a decorative ceiling panel system for a fraction of the cost of the two systems combined.

Other features, characteristics and advantages of the ceiling insulation system of the present invention will become apparent after a reading of the following specification.

DETAILED DESCRIPTION OF PREFERRED EMBODIMENTS

Figure 1:
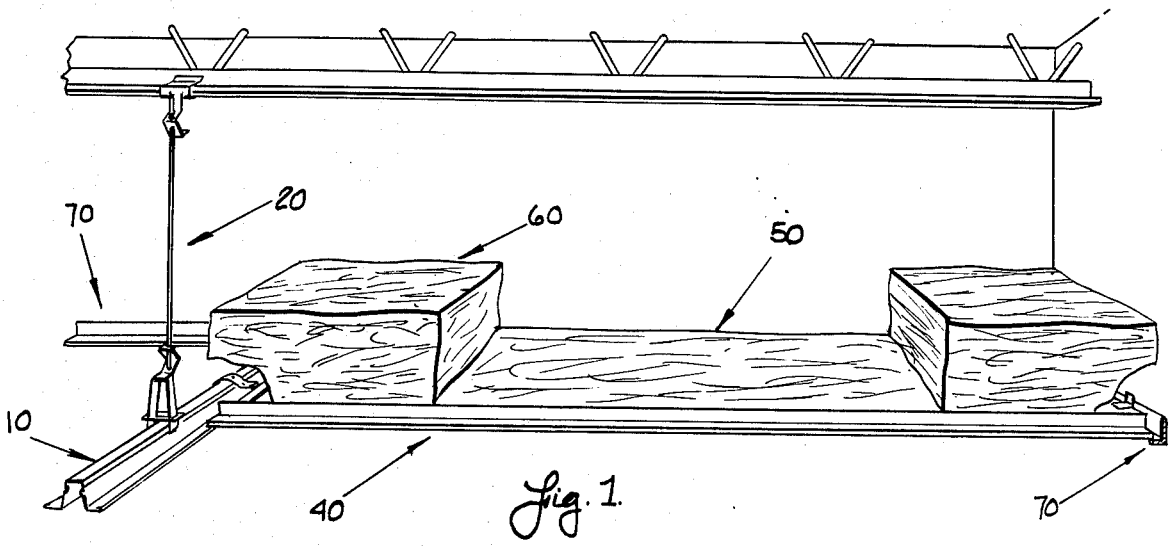
FIG. 1 is a perspective view of one section of the ceiling insulation system with portions broken away.

The components of the ceiling insulation system are depicted in FIG. 1 with details of these various components being more clearly shown in FIGS. 2–6. The ceiling insulation system of the present invention comprises a hat-shaped channel 10, a suspension means 20, a cross-T channel member 40, a generally rigid insulation board 50, fiber glass batts 60 and L-shaped wall channel members 70.

Figure 2:
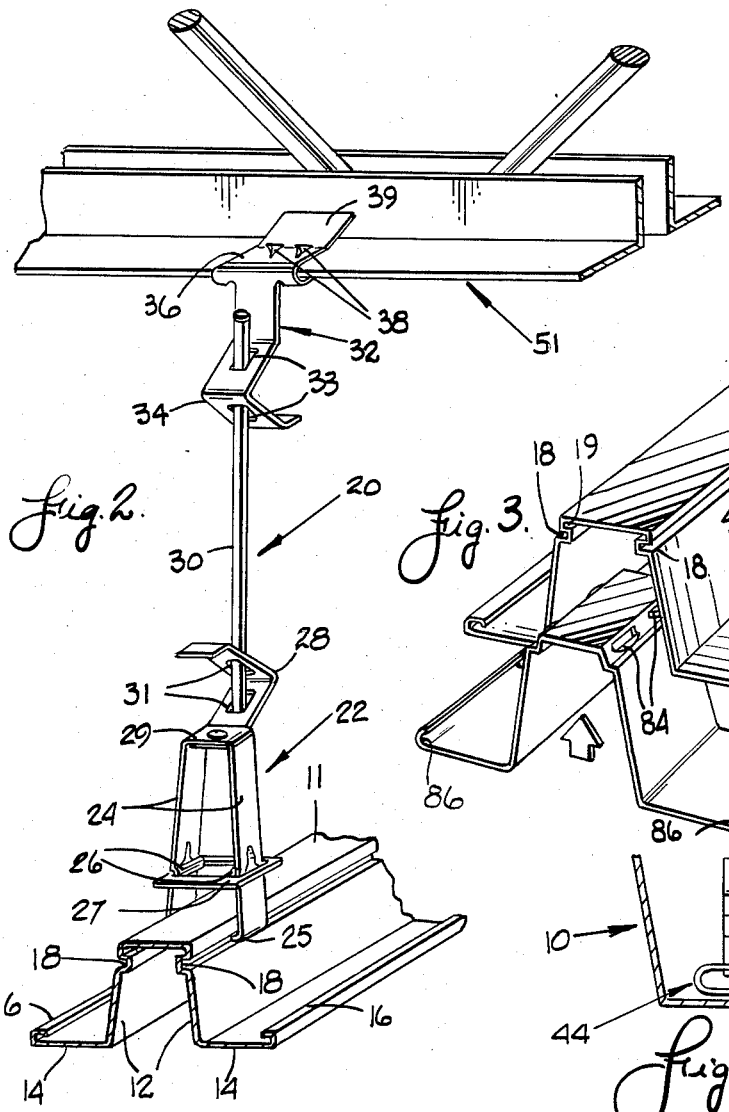
FIG. 2 is an enlarged perspective view of the hat-shaped channel and suspension system of the present invention.

As seen more clearly in FIG. 2, hat-shaped channel 10 comprises a generally flat, central top 11, a pair of diverging legs 12, and a pair of laterally extending flanges 14. The edges of flanges 14 are rolled or curled as at 16 to reinforce the channel and, as will be seen later, to provide a means of connection for cross-T channel 40. A non-penetrating recess in the form of a pair of opposed longitudinally extending grooves 18 form the means by which channel 10 may be mounted using suspension means 20.

Suspension means 20 is also more clearly seen in FIG. 2. It comprises a C-shaped clamp 22 which has a pair of divergent arms 24 with a groove engaging finger 25 (only one shown) at the end of each arm 24. Also, in each arm is an indentation 26 which together form an opposed pair. Indentations 26 receive a locking or clamping ring 27 which hold fingers 25 in clamping engagement with grooves 18. Fingers 25 may slide in grooves 18 to permit relative adjustment. A first spring clamp 28 is affixed to the central section 29 of C-shaped clamp 22 and has a pair of generally rectangular apertures 31.

A smooth cylindrical rod 30, preferably one-quarter inch in diameter, extends between the first spring clamp 28 and a second spring clamp 34 which is formed as an integral part of securing means 32. Spring clamp 34 also has a pair of generally rectangular apertures 33. Securing means 32 includes a C-shaped gripping portion 36 for engaging the flange of bar joist 51. A pair of tangs 38 are folded downwardly to dig into the flange of bar joist 51 to prevent unwanted removal of the securing means 32. A leading camming edge 39 enables the fingers of the C-shaped gripping portion 36 to be sprung open when gripping portion 36 is tapped onto the flange of bar joist 51 with a hammer or the like.

The spring clamps 28 and 34 cause the ends of the apertures 31 and 33 to bite into smooth rod 30 and to thereby secure it against movement. Pinching of the spring clamps 28 or 34 free the rod for easy adjustment. A downward force on the hat-shaped channel tends to further open the spring clamps causing the edges of apertures 31 and 33 to bite rod 30 harder and further increase resistance to movement. All structural support members, including the spring clamps, have been designed to support 50 to 80 pounds of insulation per section. Further, these members have a design safety factor of five to one, so they may support up to 250 pounds before failure. With such a design criterion, the ceiling insulation system of the present invention can support up to R-38 fiber glass insulation.

Cross-T channel 40 (FIGS. 3 and 4) comprises a pair of laterally extending flanges 42 with a centrally upstanding web 41. Web 41 may have a V-shaped reinforcing rib 43 for structural strength. Alternatively, cross-T channel may be formed with a bulb extending along the upper edge of web 43 a C-shaped cross-T channel clip 44 connects the cross-T channel 40 to the hat-shaped channel 10. Upper jaw 45 of C-shaped clip 44 is bifurcated with each projection 46 having inwardly directed teeth 47 for engaging opposite sides of web 41. Lower jaw 45 has a pair of upwardly directed tangs 48 for engaging the bottoms of flanges 42 of cross-T channel 40. Teeth 47 and tangs 48 cooperate to prevent connector clip 44 from being easily removed from the end of cross-T channel once it has been engaged.

A lip 49 is bent upwardly and engages under rolled edge portion 16 of hat-shaped channel 10. For this reason, it is preferred that rolled edge portion 16 circumscribe a 270° arc. Channel-T clip 44 prevents both axial displacement of cross-T channel 40 away from hat-shaped channel 10 and vertical displacement while permitting the cross-T channel to slide along hat-shaped channel 10 with lip 49 sliding longitudinally in rolled edge portion 16. Clip 44 may be first attached to the end of cross-T channel 40 and then lip 49 slid into rolled edge portion 16 or lip 49 may be first snapped under edge portion 16 and then the end of channel 40 pressed into clip 44.

Figure 3:
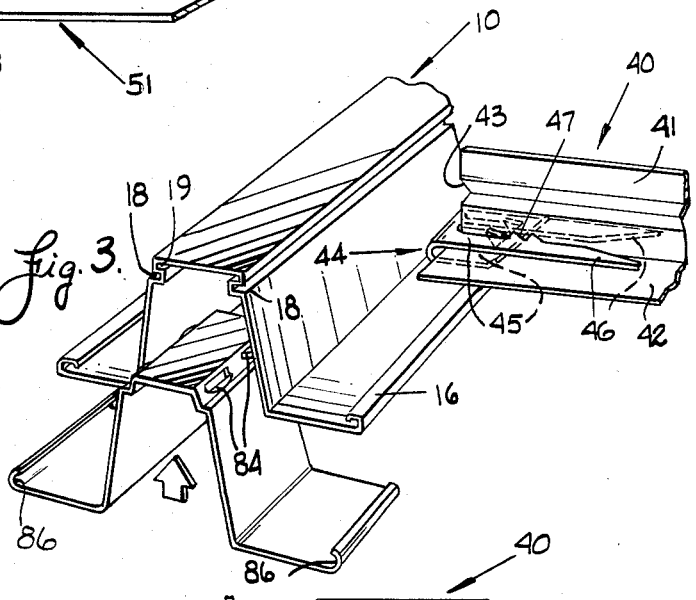
FIG. 3 is an enlarged perspective showing the hat-shaped channel, cross-T channel, their interconnecting clip and the channel junction clip of the present invention.
Figure 4:
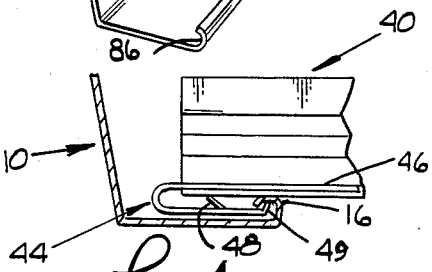
FIG. 4 is an end view of the cross-T connection shown in FIG. 3.

Also shown in FIG. 3 is a channel junction clip 80. Channel junction clip 80 has the same general configuration as hat-shaped channel 10. A plurality of protrusions 84 are formed on each leg 82 of junction clip 80. These protrusions 84 snap into the recess 19 formed above longitudinal grooves 18. Further, curled edges 86 snap over the rolled edges 16 of hat-shaped channel 10. Junction clip 80 may be attached by upward movement as shown in FIG. 3, snapping into place or by sliding axially onto the end of channel 10. End clip 80 insures alignment and continuity of abutting channel sections 10. In addition, end clip 80 minimizes possible air leaks between channel ends. Lastly, by maintaining the sections in alignment, end clip 80 insures a proper seal between the rolled edge 16 and insulation board 40.

Figure 5:
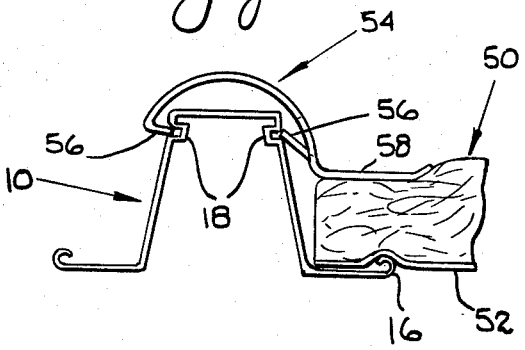
FIG. 5 is an end view of the hat-shaped channel and showing the insulation board clamp of the present invention.
Figure 6:
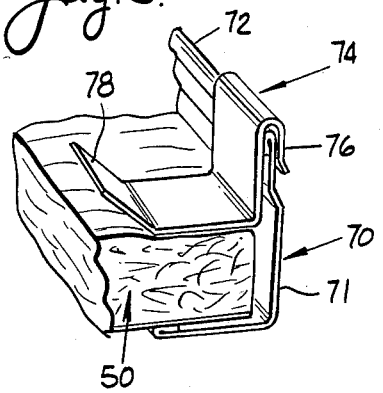
FIG. 6 is an enlarged perspective of the L-shaped wall channel and the insulation board edge clamp which is used with the wall channel of the present invention.

The generally rigid insulation board 50, in the preferred embodiment, is a faced fiber glass. Such a board may, for example, have a thickness of 1½", a density of 1.5 pcf and an insulating R-value of 6. The facing 52 (FIG. 5) preferably a vinyl and, even more preferably, a vinyl reinforced with a foil-scrim-kraft laminate. As shown in FIG. 5, an insulation board clamp 54 is used adjacent each corner of board 50 which is supported by a hat-shaped channel 10. Board clamp 54 has a pair of spring fingers 56 which engage in longitudinal grooves 18 and insure that restraining arm 58 exerts a compressive force on insulation board 50. This will, in turn, insure a proper seal between rolled edge 16 and vapor barrier 52 and prevent upward movement of the board relative to channel 10.

Along the building walls, a hat-shaped channel would be both unnecessary and unwieldy. Therefore, an L-shaped wall channel 70 is used. Wall channels 70 may be fastened to the wall with nails, screws, molly-bolts, or the like, by means of holes (not shown) in the central portion of flange 71. Wall channel 70, as better seen in FIG. 6, has an upper flange portion 72 which is laterally offset. This enables the use of an edge clamp 74 along the walls. Edge clamp 74 includes a U-shaped clip portion 76, an intermediate horizontal portion 77, and an upwardly extending camming portion 78. In use, U-shaped clip portion 76 is engaged over offset flange 72. A plurality of protuberances (not shown) on the inner surface of the clip 76 provide secure engagement with flange 72. After the other components of the system are in place, the edge of insulation board 50 may be slid under edge clamp 74 using camming portion 78 to bring the board into proper alignment.

Figure 7:
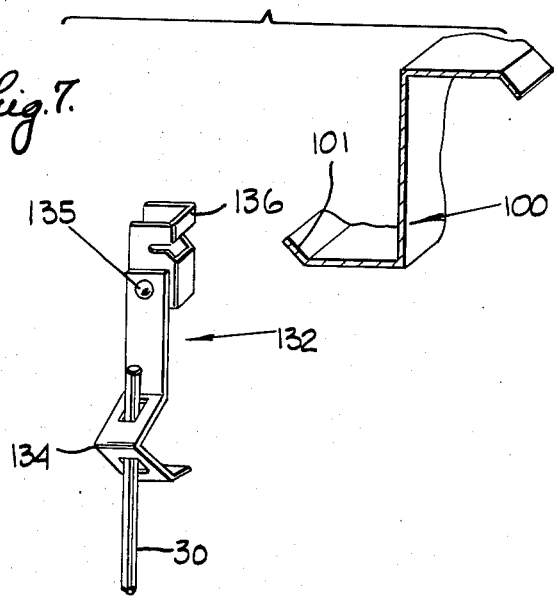
FIG. 7 is a perspective view of an alternate suspension clip of the present invention for use with Z-shaped purlins.
Figure 8:
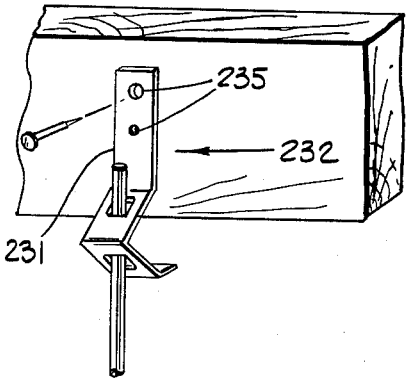
FIG. 8 is a perspective view of an alternate suspension clip of the present invention for use with wooden joists.

FIGS. 7 and 8 depict alternative suspension hangers 132 and 232, respectively. Suspension hanger 132 is for use with an Z-shaped purlin instead of the bar joist depicted with the first embodiment. Gripping portion 136 is secured to spring clamp 134 by rivet 135. A pair of tangs (not shown) prevent gripping portion 136 from being accidentally removed from the purlin 100 after attachment, as in the case with the first embodiment. Rivet 135 holds spring clamp 134 tightly to gripping portion 136. However, should the purlin have a 45 or 90 degree flange as at 101, rivet 135 will allow pivotal movement (by tapping with a hammer) so that suspension rod 30 can remain vertically oriented.

FIG. 8 depicts yet a second alternate suspension hanger 232 for use with wooden joists. Rectangular arm 231 may be attached to the lateral face of a wooden joist by means of nails or screws being received through apertures 235. By bending arm 231 into an L-shape, hanger 232 can be configured to attach to the bottom rather than to the side of a wooden joist. So configured, hanger 232 could be utilized to attach the ceiling insulation system to the bottom of a steel bar joist or purlin using self-drilling, self-tapping screws.

The hat-shaped channel 10 and the wall channel member 70 are both preferably made of 26 gauge galvanized steel. Both channels are preferably coated on all major surfaces with a vinyl (polypropylene) based paint. The hat-shaped channel and wall channel member are provided in approximately 10 foot length sections. The configuration of the channel and gauge of the metal have been designed and selected to produce no greater than a 0.2 inch deflection of the channel anywhere throughout its length when the insulation system is installed and, preferably, no greater than a 0.1 inch deflection.

The cross-T channel 40 is a sheet aluminum having a thickness of 0.019 inch and is coated with the same vinyl as the other two channel members. Cross-T channel sections are provided in 58 inch lengths for a system with hat-shaped channels on five foot centers. Suspensions rods 30 are provided in lengths of eight feet, ¼"

galvanized cold rolled steel and cut to lengths necessary, depending on the amount of drop desired. For applications in which a horizontal ceiling is desired in a highly pitched peaked-roof building, ten foot length rods are available.

Suspension hanger elements 22, 32, 132, and 232 are all constructed of spring steel and finished with a black zinc phosphate coating. Board clamps 54 and 74, as well as cross-T channel clip 44 are also made of spring steel but finished with a yellow zinc-chromate coating. Channel junction clip 80 is made of 26-gauge galvanized sheet steel and coated with a white vinyl paint (or the like) to be color compatable with all other visible channels and with the insulation boards.

In installing the ceiling installation system of the present invention, it is easiest to start in a corner. If a symmetrical appearance is desired, the size of the wall bordering panels must be calculated using the overall building or room dimensions. Two wall channel sections 70 are mounted on orthogonal walls at the height desired for the ceiling. Board edge clamps 74 are clipped onto wall channels 70 in positions to engage the three corners which will be supported by the wall channels. A 10-foot hat-shaped channel section 10 is then suspended from the joists using suspension means 20 with the appropriate suspension hangers 32 (or 132 or 232). Channel 10 is suspended perpendicular to the direction the joists run so that their spacing can be selected independent of the joist spacing. This channel section is positioned 59 inches from the first wall. (Note, hat-shaped channels will normally be 5 feet on centers. The variation is a result of the difference in wall channel vs. hat-shaped channel.) Hat-shaped channel 10 should overlap the one wall channel 70 and be fixedly attached in position by pop-riveting or the like. A 58 inch length cross-T channel section 40 is positioned four feet from the second wall and should overlap both the wall and hat-shaped channels. The cross-T channel may be pop-riveted to the wall channel and connected to the flange of hat-shaped channel 10 using cross-T channel clip 44.

A 48"×58" section of rigid faced fiber glass insulation board 50 can be cammed into position under clamps 74 and the two corners supported by the hat-shaped channel clamped using insulation board clamp 54. A plurality of fibrous batts 60, preferably 15"×4' with insulation R-values ranging from R-11 to R-38, depending on thickness, are positioned on board 50. The system is installed by repeating the above mentioned steps and attaching a channel junction clip 80 over abutting ends of hat-shaped channel sections 10.

The ceiling insulation system of the present invention provides an attractive, effective, insulation system which is easily installed at a fraction of the combined cost of separate insulation and decorative ceiling systems. Further, the principle suspending component, the hat-shaped channel, is free of penetrating apertures which can defeat the insulation and vapor barrier of the system. The suspension hangers provide a means to support 50 to 80 pounds per section while still enabling easy adjustment to achieve uniform height during installation. The system of the present invention has the flexibility to be used with any joist or purlin design, A-frame or flat roof construction, and can significantly reduce the area to be heated or cooled while also reducing the amount of heat egressing in winter and ingressing in summer.

Various changes, alterations or modifications will become apparent as a result of reading the foregoing specification. Accordingly, it is intended that all such change, alterations or modifications as come within the scope of the appended claims be considered part of the present invention.

I claim:

1. A ceiling insulation system comprising:

(a) a support channel having (i) a longitudinal uppermost surface; (ii) a pair of generally downwardly extending legs projecting from either side of said uppermost surface; (iii) a pair of laterally extending support flanges projecting from said legs; and (iv) a pair of oppositely positioned, generally downwardly-facing engagement surfaces formed in said legs extending longitudinally intermediate said uppermost surface and said laterally extending flanges:

(b) suspension means including (i) joist/purlin attachment means;

(ii) a suspension rod;

(iii) support channel engaging means in the form of a C-shaped clamping member with two arms each having a generally inwardly extending finger, said fingers extending inwardly beneath said downwardly facing engagement surfaces to support said channel; a means for clamping said fingers in their channel-engaging position; and (iv) means for securing said support channel engaging means to said suspension rod; and (c) a generally rigid insulation board, said board being at least partially supported on one of said laterally extending flanges of said support channel.

2. The ceiling insulation system of claim 1 wherein said rigid insulation board is faced fiber glass, said facing forming a vapor barrier.

3. The ceiling insulation system of claim 2 wherein said rigid insulation board supports additional insulation thereon.

4. The ceiling insulation system of claim 3 wherein said additional insulation comprises unfaced fiber glass batts.

5. The ceiling insulation system of claim 1 wherein said laterally extending flanges have edges which are curled over.

6. The ceiling insulation system of claim 5 wherein the curled edges extend through approximately a 270° arc.

7. The ceiling insulation system of claim 1 further comprising a channel junction clip, said channel junction clip conforming generally to the shape of said channel and being adaped to snap into overlapping engagement with the abutting ends of two channel sections to maintain their alignment.

8. The ceiling insulation system of claim 1 wherein said joist/purlin attachment means comprises a toothed clip for engaging a projecting flange of said ceiling joist/purlin and spring clip means for attachment to said suspension rod.

9. The ceiling insulation system of claim 1 wherein said joist/purlin attachment means comprises an arm with plurality of fastener-receiving apertures therein for receiving a plurality of nail/screw type fasteners to attach said arm to a wood joist and spring clip mans for attachment to said suspension rod.

10. The ceiling insulation system of claim 5 further comprising a cross-T channel having a horizontal flange and an upstanding central web, said cross-T channel extending between adjacent parallel support channel sections between adjacent ends of said rigid board sections.

11. The ceiling insulation system of claim 10 further comprising a cross-T channel clip for securing said cross-T channel to said support channel said channel clip having an upwardly extending lip which engages under said curled over flange of said support channel, said lip permitting said cross-T channel to be slid longitudinally along said laterally extending flange but resisting upward and lateral movement of said cross-T channel.

12. The ceiling insulation of claim 11 wherein said cross-T channel clip comprises a generally C-shaped member with an upper bifurcated jaw and a lower jaw, said bifurcated jaw having inwardly directed teeth for engaging the central web of said cross-T channel and said lower jaw having at least one tang for engaging the horizontal flange of said cross-T channel, said teeth and tang serving to secure said clip to said cross-T channel.

13. The ceiling insulation system of claim 1 further comprising an insulation board clamp with spring fingers which engage said downwardly-facing engagement surfaces, said board clamp having a restraining arm extending over the edge of said rigid insulation board to resist upward movement off of said laterally extending flange, said board clamp being constructed of a single piece of spring steel, or the like.

14. The ceiling insulation system of claim 1 wherein said support channel is formed of galvanized sheet metal.

15. The ceiling insulation system of claim 14 wherein said sheet metal is 26 gauge.

16. The ceiling insulation system of claim 14 wherein the sheet metal is of such a gauge that said support channel exhibits no more than 0.20 inch deflection anywhere along its length when supporting a capacity load of insulation.

17. The ceiling insulation system of claim 16 wherein the sheet metal is more preferably of such a gauge that the support channel exhibits no more than 0.10 inch deflection anywhere along its length when supporting a capacity load of insulation.

18. The ceiling insulation system of claim 14 wherein the galvanized sheet metal of said support channel is coated on all major surfaces with a coating such as a vinyl-based paint.

19. The ceiling insulation system of claim 1 further comprising an L-shaped wall channel member for mounting on existing walls and, in conjunction with said support channel and a cross-T channel attached thereto, for supporting a section of said rigid insulation board.

20. The ceiling insulation system of claim 19 further comprising a board edge clamp having a U-shaped clip portion by which said clamp is secured to the vertically extending flange of said L-shaped channel member, said clamp also having a horizontal portion for engaging the upper surface of said rigid insulation board and an upwardly angulated camming portion for ease of inserting the board.

21. A ceiling insulation grid including a support channel with an uppermost surface portion, two legs extending downwardly therefrom, two laterally projecting flanges extending outwardly from said legs, the terminal ends of said flanges being curled over, and a cross-T channel having a horizontal flange and a central upstanding web the improvement comprising a cross-T channel clip for securing the cross-T channel to said support channel, said clip having a generally C-shaped configuration formed by an upper bifurcated jaw and a lower jaw, said upper bifurcated jaw having inwardly directed teeth for engaging the central web of said cross-T channel and said lower jaw having at least one tang for engaging the horizontal flange of said cross-T channel, said teeth and tang serving to secure said clip to said cross-T channel, said lower jaw further having an upwardly extending lip which engages under the rolled over edge of said support channel flange to restrict upward and lateral movement of said cross-T channel while permitting sliding movement of said cross-T channel along said support channel flange for the purpose of adjustment.

* * * * *